US007146765B2

(12) United States Patent
Sanke et al.

(10) Patent No.: US 7,146,765 B2
(45) Date of Patent: Dec. 12, 2006

(54) SECURED EMERGENCY RELEASE DEVICE AND USE OF SAME

(75) Inventors: Michael Sanke, Rheda-Wiedenbrück (DE); Viktor Schütz, Arnsberg (DE); Patrick Euteneuer, Melle (DE)

(73) Assignee: Hormann KG Antriebstechnik, Steinhagen (DE)

( * ) Notice: Subject to any disclaimer, the term of this patent is extended or adjusted under 35 U.S.C. 154(b) by 154 days.

(21) Appl. No.: 10/700,053

(22) Filed: Nov. 4, 2003

(65) Prior Publication Data

US 2004/0154225 A1 Aug. 12, 2004

(30) Foreign Application Priority Data

Nov. 5, 2002 (DE) ..... 102 51 471
Dec. 3, 2002 (DE) ..... 102 56 480

(51) Int. Cl.
*E05F 15/00* (2006.01)

(52) U.S. Cl. ..... 49/139

(58) Field of Classification Search ..... 49/139, 49/140; 160/188, 189; 74/625
See application file for complete search history.

(56) References Cited

U.S. PATENT DOCUMENTS 3,512,302 A * 5/1970 Kapik et al. ..... 49/139
4,098,023 A * 7/1978 Slopa ..... 49/139
5,222,403 A * 6/1993 Angelini et al. ..... 74/89.21
5,698,073 A 12/1997 Vincenzi
6,253,824 B1 * 7/2001 Mullet et al. ..... 160/188
6,325,134 B1 12/2001 Mullet
6,427,749 B1 8/2002 Swink
6,561,255 B1 * 5/2003 Mullet ..... 160/188
6,568,454 B1 * 5/2003 Mullet et al. ..... 160/188
6,605,910 B1 * 8/2003 Mullet et al. ..... 318/264

FOREIGN PATENT DOCUMENTS

DE 8628703 U 2/1987
DE 20203221 U 5/2002

* cited by examiner

*Primary Examiner*—Jerry Redman
(74) *Attorney, Agent, or Firm*—Stevens, Davis, Miller & Mosher, LLP

(57) ABSTRACT

The invention relates to an emergency release device for a building closure operator for decoupling a motorized building closure from a motor operator assembly under emergency conditions. To diminish the risk of injury by free-fall of a decoupled building closure wing by a simple and cost-effective design the invention proposes providing a safety or securing unit which safeguards or secures the emergency release device against unintentional or unauthorized actuation.

30 Claims, 9 Drawing Sheets

SECURED EMERGENCY RELEASE DEVICE AND USE OF SAME

FIELD OF THE INVENTION

The invention relates to an emergency release device for a building closure operator for decoupling a motorized building closure from a motor operator assembly in cases of trouble or interruption.

PRIOR ART

Emergency release devices of this kind are known on door operators as available on the market. With building closures, such as, for example, doors motorized by a driving apparatus, such as e.g. a door operator or the like, it may happen in a trouble situation, such as e.g. a power outage or the like, that the building closure is locked in place by the disabled driving apparatus. Basically, self-locking in building closure operators is desirable for providing security against forced entry. On a power outage, however, someone having authorized access could be locked out or locked in thereby. Thus, to re-enable the building closure, there is a need to permit decoupling the building closure from the operator in a trouble situation. This is why many door operators available on the market feature a suitable emergency release device with which the operated closure, i.e. in this case the door, can be decoupled from the operator and the door opened or closed manually in such a situation. This is especially the requirement in situations where the powered closure closes off the sole access opening to the room or space closed off thereby.

A hazardous situation may materialize in this case where overhead building closures are concerned, such as, for example, sectional doors, vertical lift doors, swing doors and the like or in the case of other building closures urging into the closed position. Should, namely, in the case of an open overhead door, the powered door leaf become disconnected from its retaining operator, the door leaf could "guillotine" or free-fall by its own weight.

Although many such building closures are fitted with a counterbalancing system, to diminish this risk, such counterbalancing means may malfunction, however, also due to material fatigue or wrong operation, for example, due to a spring used for counterbalancing having ruptured. This will allow the decoupled door leaf to free-fall, damaging an object or injuring a person trapped underneath. Thus, overhead doors are already available on the market which feature, in addition to a counterbalancing system, a mechanical disconnect to prevent the door leaf from free-falling should the counterbalancing means malfunction. On such doors the free-fall risk on actuation of an emergency release device initiating decoupling of the door operator is diminished. However, such a design is complicated and expensive.

Also already available on the market is a door operator for overhead doors which permits decoupling the door leaf only when the latter is fully down. For this purpose a travel simulator is provided on the door operator indicating the position of the door leaf at the particular time. But this too, is complicated and expensive.

SUMMARY OF THE INVENTION

It is thus the object of the invention to configure an emergency release device of the kind as mentioned above so simple and cost-effectively that the risk of damage or injury by a building closure wing free-falling when decoupled is diminished even in the case of building closures designed less complicated.

This object is achieved by an emergency release device for a building closure operator for decoupling a motorized building closure from a motor operator assembly in cases of trouble which is characterized by a safety or securing means, safeguarding the emergency release device against unintentional or unauthorized actuation.

Now, to be able to actuate the emergency release device the safety or securing means must first be defeated. In other words, in addition to actuating the emergency release device, now a further step needs to be implemented intentionally, automatically forcing the user to think again in preventing reckless actuation of the emergency release device which in particularly unfortunate circumstances would otherwise cause the building closure wing to free-fall with negative consequences.

The safety or securing means in accordance with the invention now makes it possible for the building closure to be decoupled in any position, i.e. even in the raised position. Thus, whilst prior art emergency release devoces provided for the building closure to be decoupled only in the closed position, the invention takes a differing approach by permitting decoupling in any position. The means, however, for decoupling is secured and/or safeguarded in ensuring that release is intentional, similar to the emergency brake principle on a train. In this case, emergency braking may also be actuated with the train at full speed, as could result in serious injuries. Since, however, the emergency brake is safeguarded by a wire seal or the like, the would-be user is cautioned that this is something he is not allowed to actuate under normal conditions. It is this principle that is put to use with the emergency release device in accordance with the invention. The emergency release device can be decoupled preferably in any position of the door, but if this is done with the building closure raised, this could free-fall. Possible dangers caused thereby are eliminated by the safety or securing device cautioning the user of what he is about to do.

The suprising thing about this is that such a simple and cost-effective solution satisfies the increasingly stringent safety requirements whilst saving on prior art complicated designs with the additional advantage that it is now possible to release a building closure even half open in an emergency to fully close or open it until the fault has been remedied.

Advantageous embodiments of the invention are subject of the sub-claims.

It is particularly preferred for the safety or securing means to be defeatable or accessible only with use of a tool. A tool in this sense is intended not only to be a usual tool, for example a screwdriver or wrench, but also some mechanical or electronic key with which a lock locking the emergency release device can be actuated. In view of the fact that electronic components are become cheaper all the time, even a keypad for entering a code could be provided as the safety means. Other alternatives provide for the safety means being accessible for defeating only in making use of a tool or key or that the safety or security means is defeatable by destruction only or that the safety or securing means is only accessible for defeating on destroying a safety feature. For example, the safety means could also feature a wire seal similar to that as known on the emergency brake of a train in preventing unintentional or unauthorized actuation of the emergency release device. Encasing the feature under glass is also conceivable in covering a means for actuating the emergency release device and requiring the glass first to be shattered before the emergency release can be enabled.

The emergency release device could be configured in various ways. So that it is still capable of functioning in a trouble case, such as a power outage, preference is given to a (purely) mechanical configuration. In accordance therewith the emergency release device features a mechanical actuating means for manual movement to actuate the emergency release device.

Further preferred, the emergency release device—as known in principle—comprises a means for coupling a self-locking operator assembly releasably to the building closure or wing to be operated. For decoupling, this coupling means is released by actuating the emergency release device. Such coupling means are naturally provided in the course of the drive train between a motor and the building closure wing and thus on overhead doors at a location with difficult access. This is why in a preferred aspect a linking transmission means is provided for linking an actuating means of the emergency release device to the coupling means. Such an actuating means may thus be secured at a location with facilitated access. Despite facilitated access any unintentional actuation is prevented by the safety means.

For this purpose it is preferred that the safety means blocks the movement of the actuating means. In an alternative or additional aspect the safety means may also block access to the actuating means, as explained above by way of the example of a safety glass housing. In addition or as an alternative thereto it may also be provided that the safety means blocks or disables the linking transmission means. It is just as conceivable that the safety means blocks the coupling means, but since the latter is usually sited at a location with difficult access, this solution is less preferred.

For securing the actuating means to a location with facilitated access a mount is preferably provided. In one preferred aspect this mounts a manual movable actuator whose movement is transmited by the linking transmission means to the coupling means to thus initiate coupling.

In such an aspect the safety means preferably comprises a blocking member for blocking the movement of or access to the manual actuator. The blocking member is preferably configured so that it enables movement of or access to the actuation only by use of a tool. As an alternative thereto a seal, splint, glass cover or the like may be provided which enables movement of or access to the manual actuator only when the safety feature is destroyed.

To avoid the risk of emergency release device sticking or jamming, i.e. particularly the actuating means, the linking transmission means or also the coupling means, it is further preferred that the emergency release device is mechanically biased in a normal operating position in which the building closure is coupled to the motor operator assembly. In this case, the emergency release device can then be actuated by the actuating means against this bias. This may be achieved, for instance, by the linking transmission means comprising a spring assembly for biasing the emergency release device into the normal operating position. Since it may occur that the building closure needs to be permanently decoupled for a while, a retaining means is provided for this case in a preferred aspect, by means of which the actuating means can be located in an actuating position in defeating the bias. In such an aspect the emergency release device can be brought into the actuating position by means of the actuating means and then maintained there by means of the retaining means, thus resulting in the building closure remaining decoupled for manual movement. This permits single person operation of the emergency release device despite its bias.

A pull handle may serve, for example, as a manual actuator. The linking transmission means may be formed by a cable means, for example a bowden cable with a sheathed cable.

As the blocking member a cap screw may be provided which secures the manual actuator to the mount of the actuating means and first needs to be released to permit actuation of the emergency release device. Despite the cap screw being released, the emergency release device initially remains in the normal operating position because of its bias. Once the cap screw has been released the manual actuator can be moved to thus activate decoupling. In other words, the user is intentionally forced to implement several steps in this case in making him realize why the manual actuator is safeguarded in this way.

This can be assisted by housing a corresponding tool needed for releasing the blocking member in the vicinity of the actuating means. Preferably also a set of instructions for use including a warning indication is posted in the vicinity of the actuating means. Thus, when a user tries to actuate the emergency release device, this will initially be thwarted by the safety or securing means. This forces him to read the corresponding instructions which informs him as to the risk of the building closure "guillotining" and tells him how the building closure is to be released whilst simultaneously avoiding the risk of damage or injury by clearing the opening of the building closure of any obstacles before actuating the emergency release device.

The emergency release device in accordance with the invention now avoids the risk of the building closure free-falling on actuation of the emergency release device even when a counterbalancing system is at fault. The emergency release device in accordance with the invention can thus be put to use on overhead building closures not provided with means to prevent "guillotining". Now, a building closure operator provided with such an emergency release device finds more universal application whilst correspondingly reducing the costs for such a building closure employing such an emergency release device.

When the actuator is provided with a tapped hole or clamping portion for receiving the cap screw serving as the safety member, this remains captive when released from the manual actuator and thus cannot be lost. A second tapped hole is provided preferably on the mount so that the manual actuator is reliably secured by the cap screw.

A wealth of other solutions having the same effect is conceivable. For instance, the actuator could also feature a locking pin bolted on the mount or some other location by a nut.

It is particularly preferred when the emergency release device is part of or an accessory to a jack-shaft operator, i.e. an operator directly connected to a drive tube or shaft geared to a moving door leaf so that rotation of the drive tube or shaft by the jack-shaft operator also results in movement of the door leaf. Such drive tubes or shafts often also serve as part of a counterbalancing system involving a torsion spring connected at one end in situ and at the other end to the drive tube or shaft. Providing such jack-shaft operators with a self-locking worm gear and a coupling means provided with and a transmission case forming a single unit with the motor is already known in general. The coupling means releasably couples a driven shaft of the jack-shaft operator to the worm gear. For actuating the coupling means, gearing can be provided on the motor housing. Preferably, the linking transmission means can be connected to such a gearing for transmitting the movement of the manual actuator with facilitated access to the lever.

One advantageous possibility of mounting the spring unit biasing the emergency release device into its normal operating position is to provide it at one end of the bowden cable employed as the linking transmission means. When, for example, a coil compression spring is employed as the elongation of the sheath, this, for one thing makes for a very simple solution, whilst, for another, such a sheathing coil compression spring also protects the tracction means, otherwise exposed at this end, from damage externally.

The mount of the actuating means is preferably provided with a fastening element defined in situ and means for retaining the emergency release device in its decoupled positions. Preferably the fastening element and the retaining means can be set and secured relative to each other in an optional arrangement in thus making them adaptable to the various situations in situ whilst permitting the location to be set.

In one configuration preferred as a concrete solution, the retaining means may feature a U-shaped supporting element or be formed by such. Due to its U-shape this supporting element has two legs with a web inbetween. On the one leg a first means for receiving the bowden cable may be formed. On the other leg a second means for receiving the manual actuator translated into its actuating position. The web may be provided slotted to permit infinitely variable adjustment of the supporting element relative to the fastening element. The web of the supporting element and the fastening element are preferably located shiftable relative to each other into engagement and locked in place relative to each other by a fastener. This is likewise achievable by the slot through which the fastener passes.

This fastener is preferably designed multifunctional by it, on the one hand, serving to locate the retaining means on the fastening element, whilst, on the other, functioning as a countermount for a safety or securing member. For this purpose the fastener preferably comprises an adapter with two tapped holes, one of which may receive a cap screw for locating the supporting element and the fastening element whilst the other may receive a cap screw acting as the safety or securing member. The adapter may be configured as a sleeve having a passage opening whose two ends serve as the aforementioned tapped holes.

The mount is preferably configured for optional securement to the left-hand or right-hand side edge of the opening to be closed off by the building closure. For example, the mount is suitable for optional securement to a left-hand or right-hand jamb of a frame of an overhead door powered by the building closure operator. Preferably serving as the fastening element for the mount is a bracket comprising a plurality of walls oriented substantially at right angles to each other. A through opening for insertion of the supporting element may be provided in the transition between these walls. Such an opening is provided at two of the transitions in a three-walled bracket as aforementioned to permit optional left-hand or right-hand securement. For the same reason the supporting element or mount is preferably configured symmetrically about a transverse centerline in the web thereof.

The receiving openings of the supporting element are preferably arranged offset from a longitudinal centerline. Thus by optionally using the one or other orientation possible by the symmetrical configuration, the bowden cable guide and/or the receiving opening provided for location can be offset as required. The three-walled bracket of the mount further comprises preferably in two of the walls at least one, preferably two openings for securing it to the wall. All of these fastening openings in the two walls are preferably located in a single plane. The fastening openings of the wall portion not serving for fastening to the wall can then be used for countermounting the fastener and/or the safety or securing member. The third wall comprises preferably at least two openings for fastening the corresponding end of the bowden cable. Here too, a plurality of openings is preferred provided to permit adapting the actuating means in situ.

BRIEF DESCRIPTION OF THE DRAWINGS

An example embodiment of the invention will now be detained with reference to the attached drawing, in which.

DETAILED DESCRIPTION OF THE INVENTION

Figure 1:
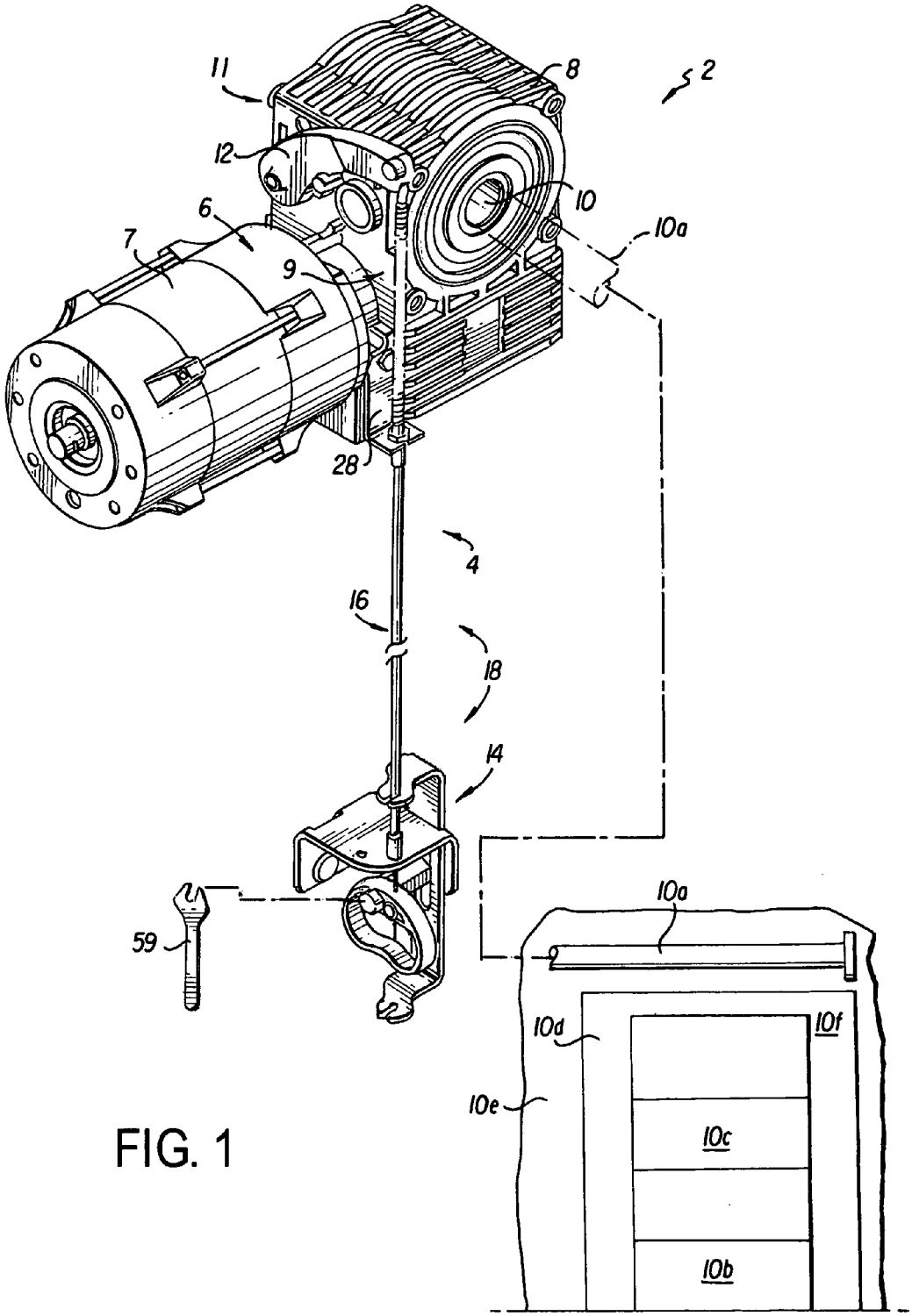
FIG. 1 is a diagrammic view in perspective of a building closure operator in the form of a jack-shaft operator including an emergency release device.

Referring now to FIG. 1, there is illustrated a building closure operator in the form of a jack-shaft operator 2 including an emergency release device 4. The jack-shaft operator 2 has an electric motor 6 accommodated in a motor housing 7 and a gearing 9 accommodated in a transmission case 8. The motor housing 7 and the transmission case 8 form a single unit. The gearing 9 comprises a self-locking worm gear (not shown) and directs the rotational force of the electric motor 6 to a driven shaft 10. Connectable to the driven shaft 10 is a door shaft or drive tube 10*a* geared to a door leaf 10*b* for vertical movement of door 10*c* relative to door jamb 10*d*. A portion of the building 10*e* is serviced by the door 10*c*.

Interposed between the driven shaft 10 and the worm gear of the gearing 9 is a coupling means 11. Such an arrangement is known in general and thus is not detained in the following. The coupling means 11 is indicated simply by a lever 12 via which the coupling means 11 can be released so that the driven shaft 10 is decoupled from the worm gear. In the position of the lever 12 as shown in FIG. 1 the coupling means 11 is in a normal operating position in which the driven shaft 10 and the gearing 9 and thus also the electric motor 6 are each coupled to the other. Downwards movement of the lever 12 as shown in FIG. 1 disengages the coupling means 11 and the driven shaft 10 is decoupled from the operator assembly formed by the gearing 9 and electric motor 6.

In addition to the coupling means 11 and the lever 12 the emergency release device 4 comprises a mechanical actuating means 14 and a linking transmission means 16. The linking transmission means 16 transmits actuation of the facilitated access actuating means 14 to the lever 12.

Figure 2:
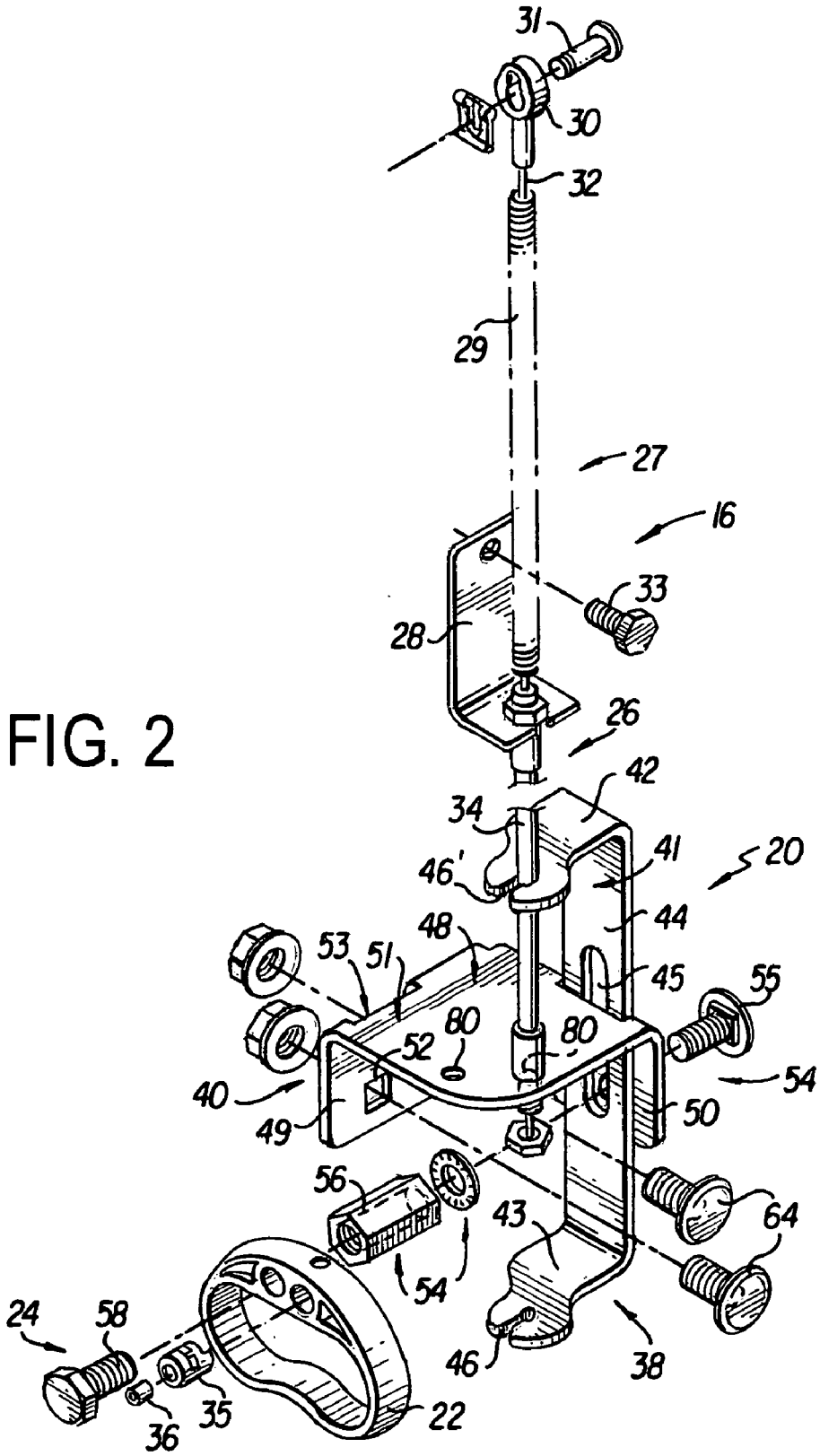
FIG. 2 is an exploded view in perspective of an actuating means and a linking transmission means of the of the emergency release device as shown in FIG. 1.
Figure 3:
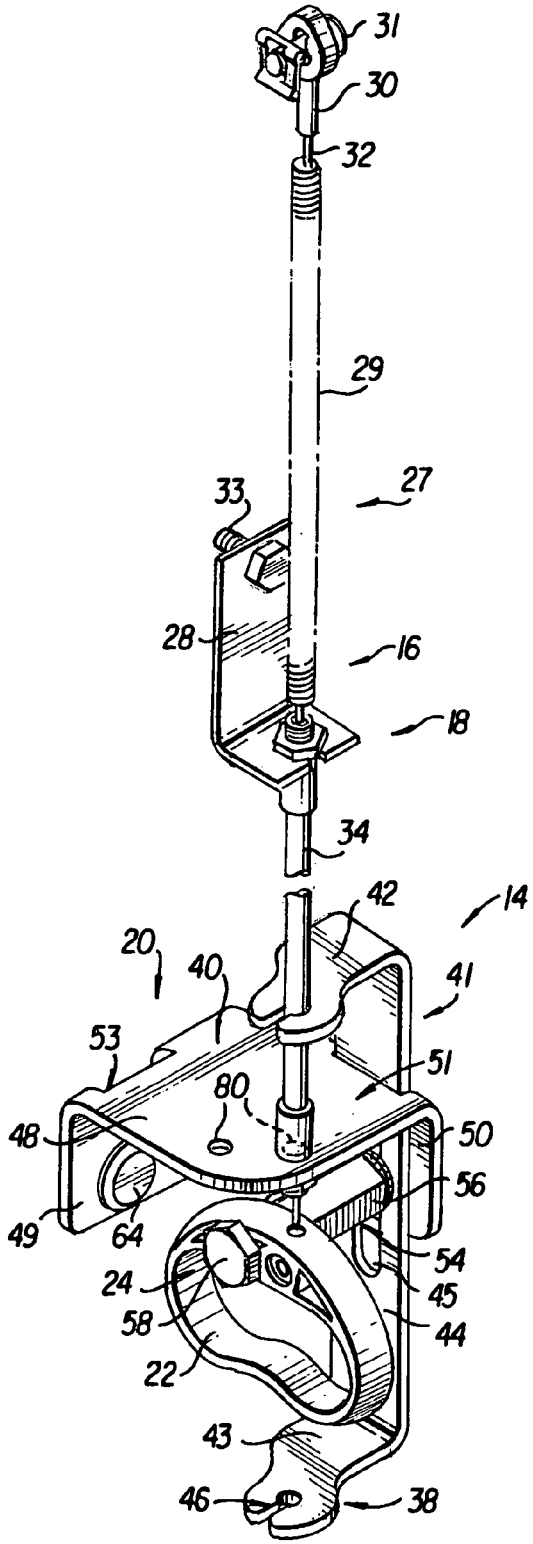
FIG. 3 is a view in perspective of the actuating means and the linking transmission means in a combined assembly.
Figure 4:
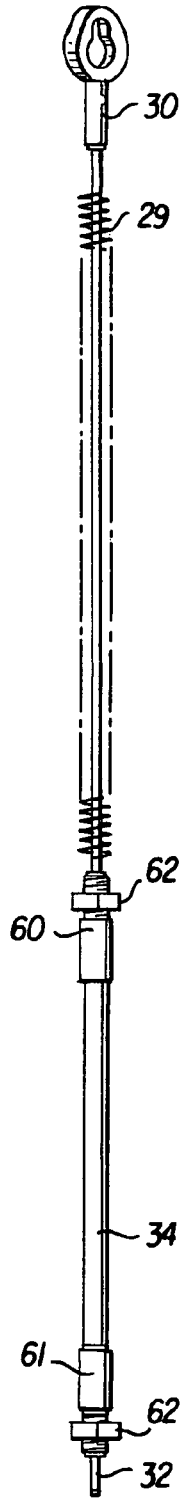
FIG. 4 is a view in perspective of the linking transmission means as shown in FIG. 3.

Referring now to FIGS. 2–4 there is illustrated the coupling actuator assembly 18 formed by the actuating means 14 and linking transmission means 16 as will now be detailed.

The actuating means 14 comprises a mount 20 and a manual actuator in the form of a pull handle 22 and a safety or securing means 24. The linking transmission means 16 comprises a bowden cable 26, a spring assembly 27 and a second mount 28.

At its end assigned to the jack-shaft operator 2 the bowden cable 26 is provided with a lug element 30 for securing to the free end of the lever 12 by means of a clinch pin 31. The cable means of the bowden cable 26 formed by a cable wire 32 is guided by a coil compression spring 29 interposed between the lug element 30 and the second mount 28.

As evident from FIG. 1 the second mount 28 can be faistened to the transmission case 8 by a (cap) screw 33. Fastened by usual ways and means to the second mount 28 is a driving end of a sheath 34 of the bowden cable 26. The other end of the sheath 34 is defined by the first mount 20 and the corresponding end of the cable wire 32 is defined at the pull handle 22 by means of a sleeve 35 and a grub screw 36.

The first mount 20 comprises a retaining means 38 and a fastening element 40.0

The retaining means 38 is formed by a U-shaped supporting element 41 comprising two legs 42 and 43 and an interconnecting web 44 configured in all symmetrically about a centerline running transversely to the middle of the web 44 parallel to the legs 42, 43. The web 44 has in the middle a slot 45.

The two legs 42, 43 are not oriented symmetrically about a longitudinal centerline running through the web 44 and the slot 45, they instead being arranged offset to one side like a crank. At their free end the two legs 42 and 43 each comprise a receiving opening 46, 46' respectively. The receiving openings 46, 46' are each configured such that they comprise an expansive inner portion including a narrow passage open to the outside.

The receiving opening 46' of the first leg 42 serves to guide the bowden cable 26, the sheath 34 being inserted through the narrow passage into the expansive opening. The second leg 43 is assigned to the pull handle 22. The receiving opening 46 of the second leg 43 serves to locate the pull handle 22 in a withdrawn position in which the cable wire 32 is correspondingly tautened to thus actuate the lever 12 as will now be detained in the following.

The fastening element 40 is formed by a bracket 48 having three walls 49 each oriented at right angles to the other. In all, the bracket 48 is configured symmetrically to a diagonal plane through the wall 51 passing through the common centerpoint of the walls 49, 50 and 51. The two walls 49 and 50 each comprise two fastening openings 52 serving, depending on the kind of securement involved, for securing to the wall or for securing the retaining means 38. Provided at each edge of these two walls 49 and 50 comprising the fastening openings 52 to the third wall 51 is an elongated passage opening 53 through which the supporting element 41 can be inserted. The third wall 51 is provided in the region of the free corner with two tapped holes 80 which may serve to countermount the bowden cable 26. To one of these tapped holes 80 a threaded sleeve 61 of the bowden cable 26 is screw-fastened.

The supporting element 41 and bracket 48 are each shiftable relative to the other and can be fixed in an optionally adjusted arrangement to each other by a fastener 54. For this purpose a locating or fixing screw 55 of the fastener 54 is guided through one of the fastening openings 52, in this case in the wall 50, and through the slot in the supporting element 41 and secured to an adapter, in this case in the form of a threaded sleeve 56 with an hexagonal profile.

The safety or securing means 24 secures the pull handle 22 in thus preventing the emergency release device 4 as a whole from being actuated unintentionally or unauthorized. It features a securing member in the form of a cap screw 58, by means of which the pull handle 22 can be locked in the normal operating position of the emergency release device 4. This is done preferably by a tool 59 (shown in FIG. 1), such as a wrench in this case, being necessary to release the cap screw 58.

In the embodiment as shown, the cap screw 58 employed as a securing member likewise engages the threaded sleeve 56 thus serving as an adapter. The threaded sleeve 56 is provided at both ends with an opening for receiving the cap screws 58, 55. More particularly, the threaded sleeve 56 has a full-length tapped hole at both ends of which the two cap screws 58, 55 can be received.

Referring now to FIG. 3 there is illustrated the coupling actuator assembly 18 assembled and safeguarded or secured. The pull handle 22 is fixedly fastened by the cap screw 58 to the first mount 20, i.e. to actuate the emergency release device 4, the cap screw 58 must first be released.

Referring now to FIG. 4 there is illustrated the linking transmission means with all its components. The lug element 30 is formed by a lug crimped to the cable wire 32 for a tensile force of at least 800 N. The sheath 34 is formed by a flat wire sleeve selected differing in length, depending on the requirements, in the range 1.5 to 13.5 m, preferance being given to lengths of 2 m, 3 m, 4 m and 13 m. The length of the cable wire 32 corresponds to the length of the sheath 34 plus the length needed for the coil compression spring 29 and the connections, including the pull handle 22 which, for example, is in the range 10 to 500 mm, preferably 250 mm.

For fastening the bowden cable 26, one of the two ends of the sheathing is fixedly crimped to a threaded sleeve 60, the other end being provided with a non-fixed threaded sleeve 61. The two threaded sleeves 60 and 61 are secured to the mounts 28, 20 by nuts 62.

Figure 6:
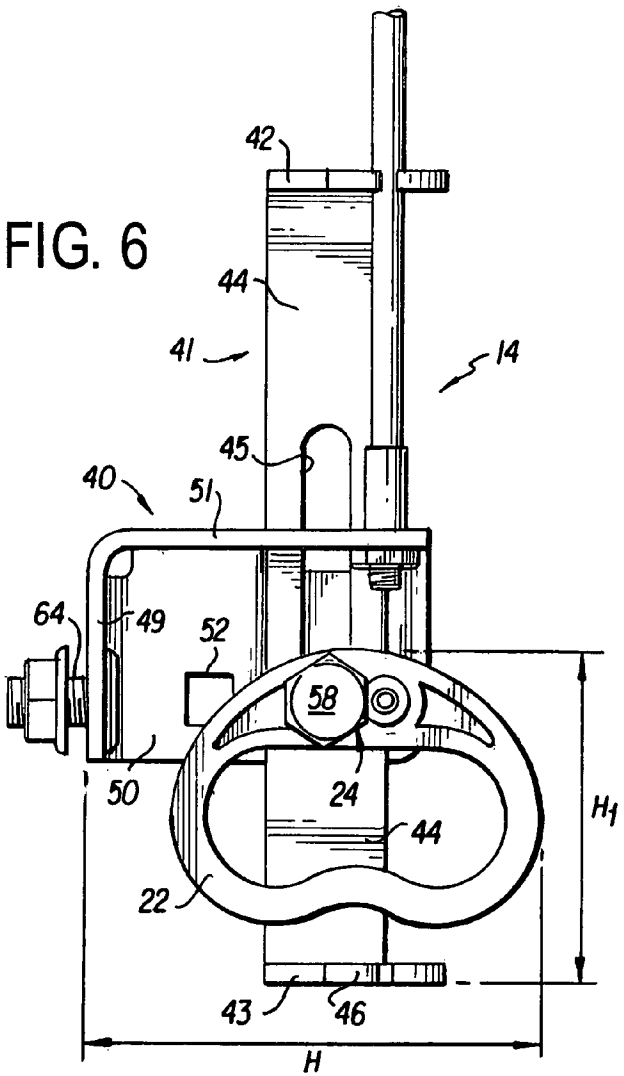
FIG. 6 is a front view of the actuating means.
Figure 5:
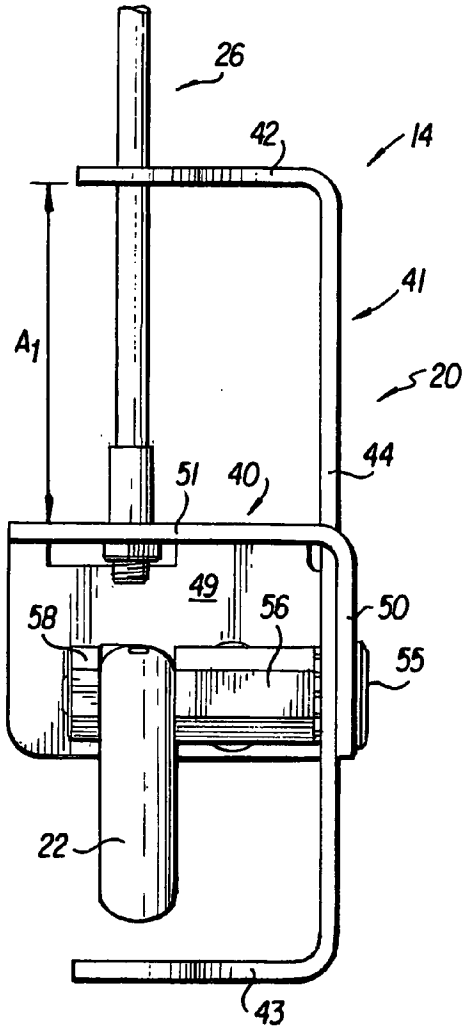
FIG. 5 is a side view of the actuating means in a first setting for a minimum stroke.

How the stroke of the retaining means 38 is set will now be described with reference to FIGS. 5–8, each illustrating the actuating means 14 in a side view and in a front view respectively. The actuating means as shown in FIGS. 5 and 6 is depicted set for a minimum stroke, whereas in FIGS. 7 and 8 a maximum stroke setting is shown.

As explained above, the retaining means 38, or more precisely its supporting element 41, can be shifted relative to the fastening element 40 and fixed in an optionally infinitely continuous setting by means of the fastener 54. This results in the length of the stroke H being varied between the normal operating position of the pull handle 22 and the actuating position in which the pull handle 22 is fixed in place by the insertion of the cable wire 32 into the receiving opening 46 of the leg 43.

Figure 8:
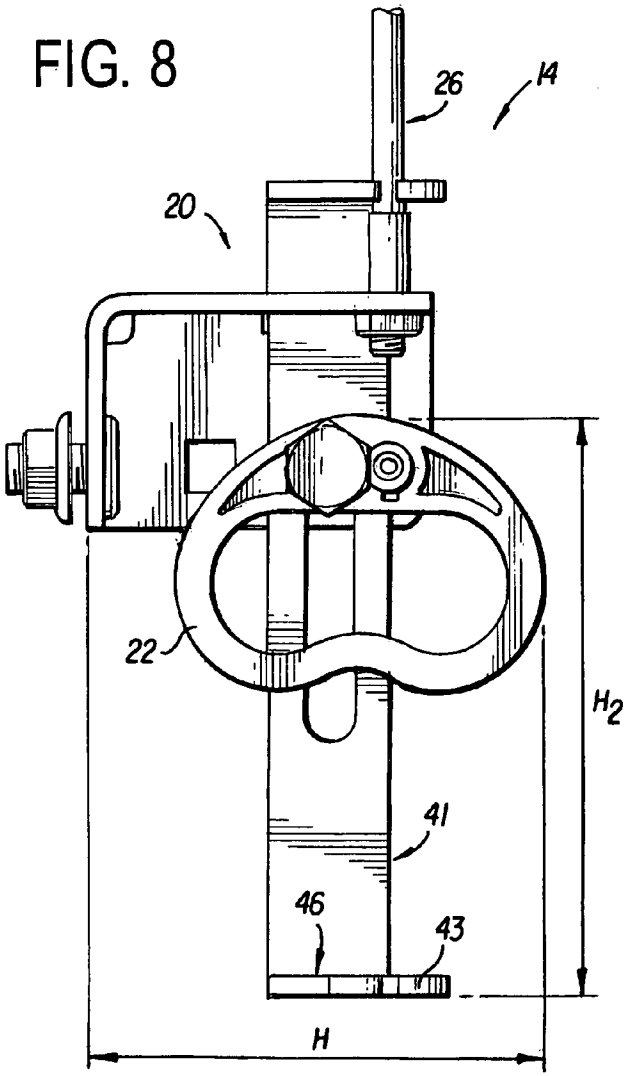
FIG. 8 is a front view of the actuating means in the maximum stroke setting as shown in FIG. 7.
Figure 7:
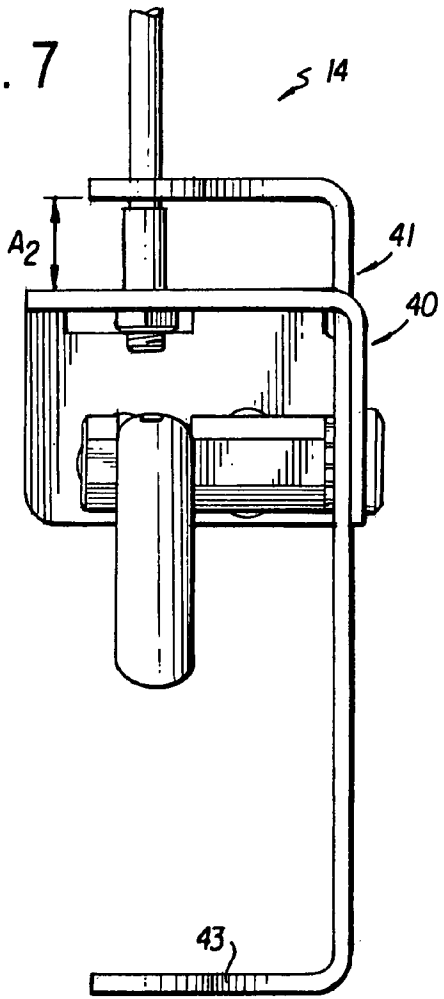
FIG. 7 is a side view of the actuating means in another setting for a maximum stroke.
Figure 9:
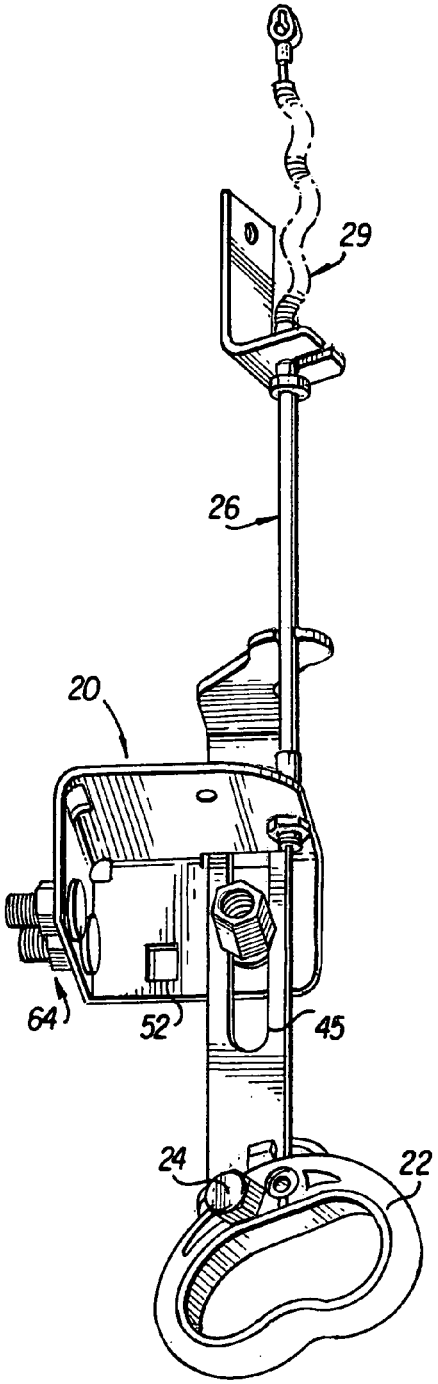
FIG. 9 is a view in perspective of the actuating means and linking transmission means in a setting for actuating decoupling.
Figure 10:
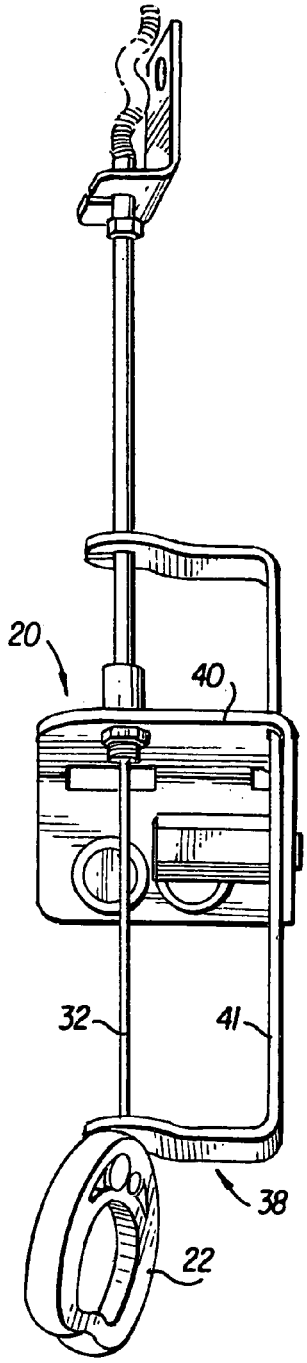
FIG. 10 is a side view of the actuating means and linking transmission means in the actuating setting as shown in FIG. 9.

This location fixed in the actuating position is also shown in the two views of FIG. 9 and FIG. 10. Here, the cap screw 58 has been unscrewed from the threaded sleeve 56. Since the pull handle 22 is provided in its tapped hole for receiving the cap screw 58 with a captive portion, the cap screw 58 cannot drop out and become lost. To form the clamping portion the tapped hole receiving the cap screw 58 in the pull handle made of plastics is configured somewhat narrower than the outer diameter of the threaded shank of the cap screw 58. With the safety or securing means 24 thus released the pull handle 22 can be pulled by hand in defeating the compressive tension of the coil compression spring 29 which strives to return the pull handle 22 to its normal operating position. The pull handle 22 can then be pulled sufficiently so that the cable wire 32 can be guided into the receiving opening 46 of the second leg 43, resulting in the pull handle 22 and thus the complete emergency release device 4 being fixed in the actuating position. By correspondingly shifting the supporting element 41 in its slot 45 relative to the fastening element 40 the stroke H with which such fixing is made, can be set infinitely continuously to permit adapting the actuating means 14 to the differing coupling stroke or differing transmission distance. This is illustrated in FIGS. 6 and 8 by the differing strokes H1 and H2. In this arrangement the supporting element 41 is also guided along the bowden cable 26 inserted in the receiving opening 46' of the legs 42. The corresponding differing spacings A1 and A2 are evident from FIGS. 5 and 7. Setting the stroke permits more particularly adapting the actuating means 14 to the differing lengths of the bowden cable, i.e. a longer bowden cable 26 requiring a greater stroke for safe release than a shorter bowden cable 26. For setting, the complete emergency release device 4 is first fitted. The pull handle 22 is pulled until release on the jack-shaft operator occurs. The supporting element 41 is shifted relative to the fastening element 40 such that it can retain the pull handle 22 in a position ensuring release. Subsequently, the two elements 40 and 41 are fixed to each other by means of the locating screw 55 and threaded sleeve 56.

The fastening element 40 can be fixed in place by cap screws 64 inserted through the fastening openings 52, preferably to a jamb of the powered door to advantage optionally in a left-hand or right-hand arrangement, depending on the motor arrangement and/or other local site requirements. This is made possible by the symmetrical configuration of the supporting element 41 and fastening element 40. Either the wall 49 or wall 50 can be used optionally for securing the supporting element 41 and safeguarding or securing the pull handle 22, the other of these walls 50, 49 being fixed in place by means of cap screws 64.

Figure 11:
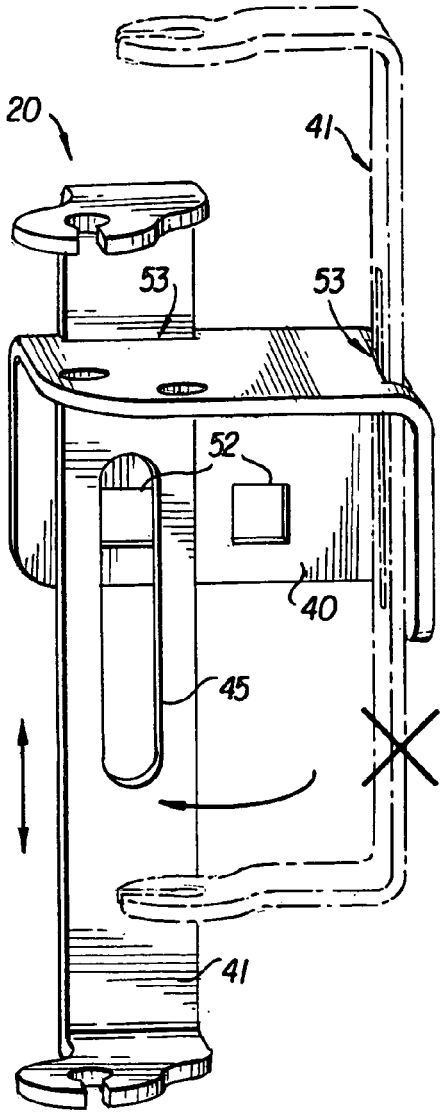
FIGS. 11, 12 are diagrammatic views in perspective of various possibilities for setting and securing a mount of the actuating means.
Figure 12:
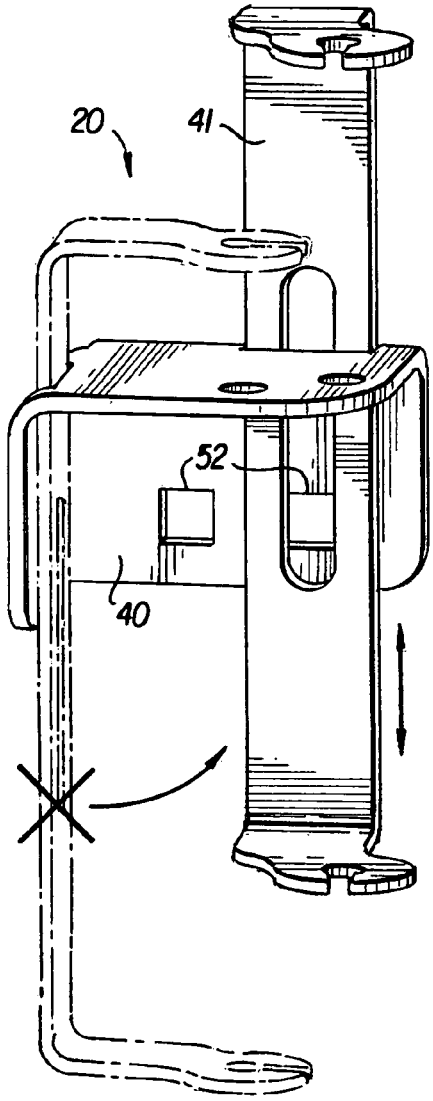
Figure 13A:
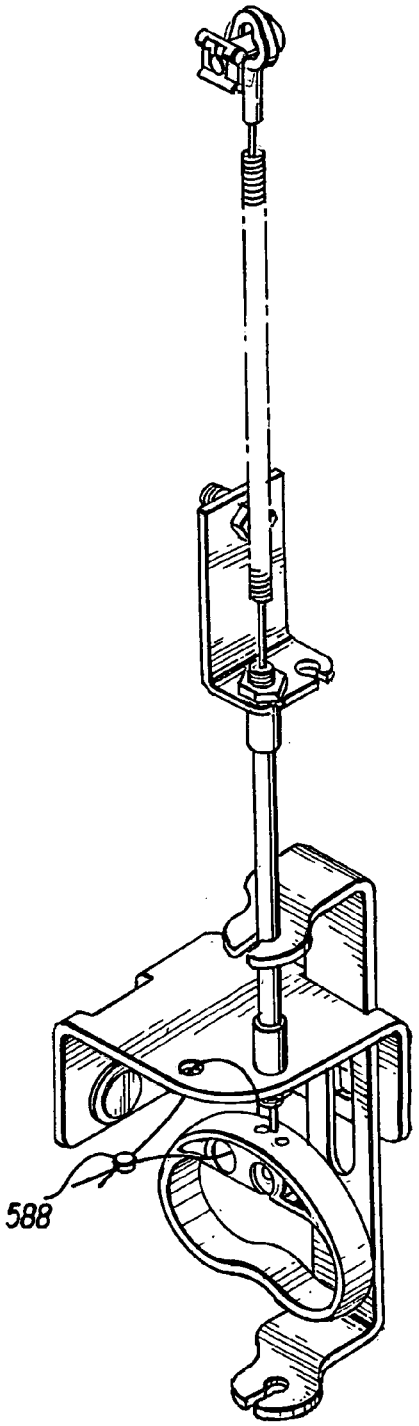
FIGS. 13*a* to 13*c* illustrate some of the various examples of safety means that require manual intervention prior to permitting decoupling of the building closure device.
Figure 13B:
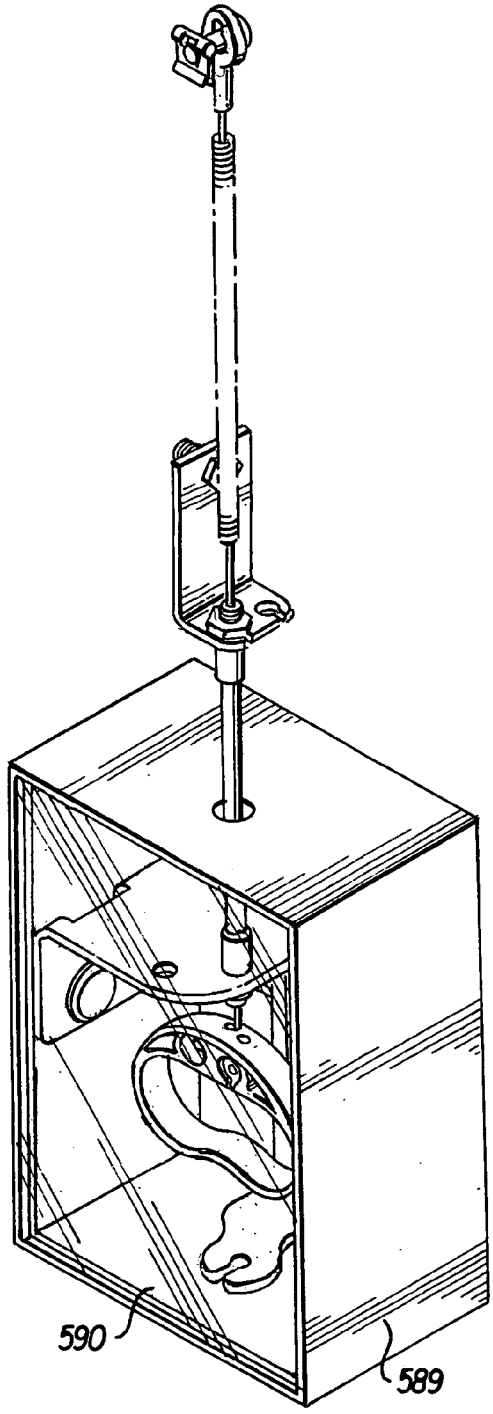
Figure 13C:
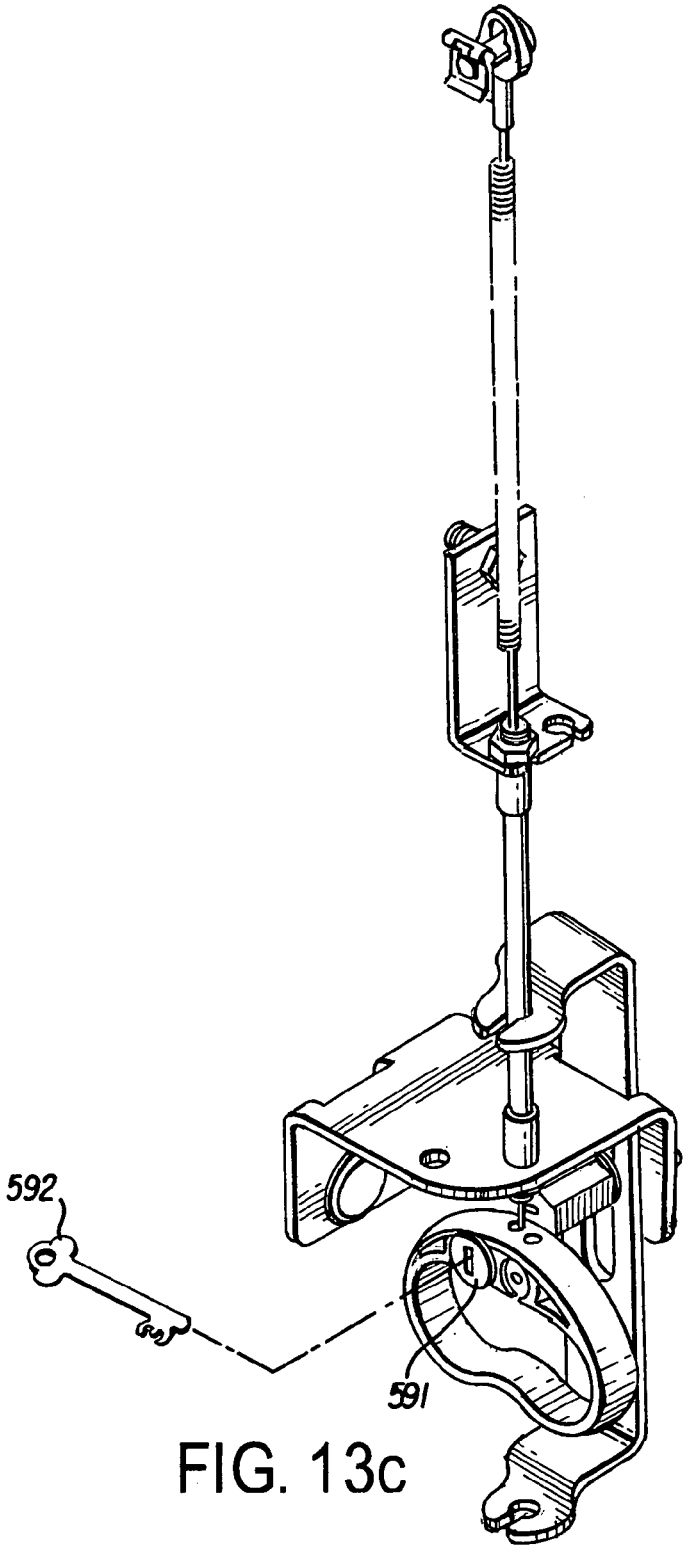

Referring now to FIGS. 11 and 12, there are illustrated the various options of setting the fastening element 40 and supporting element 41, FIG. 11 showing a left-hand mounting option and FIG. 12 a right-hand mounting option. In addition, FIGS. 13*a*, 13*b* and 13*c* respectively show some different types of manual intervention that must be neutralized prior to activating the decoupling means. For example, FIG. 13*a* shows a wire seal 588 used instead of screw 58. The wire seal 588 must be broken before the decoupling means can be activated. FIG. 13*b* shows a case 589 having a glass front 590 that has to be broken before accessing the decoupling means. Finally, FIG. 13*c* illustrates a lock 591 that requires a key 592 to be inserted into the lock 59 to unlock the lock before actuating the decoupling means.

The configuration as described in this case permits fitting the jack-shaft operator also to doors comprising no safety means against spring breakage or free-fall. Now, due to the safety or securing means personal injury or object damage are prevented even when used on such doors having no safety feature, because the safety means in accordance with the invention can be defeated only intentionally.

What is claimed is:

1. An apparatus comprising an overhead building closure door, an emergency release device, and; an automated door closure assembly, said door closure assembly including a drive motor, and engagement means for engaging with said drive motor for moving a door from a first open position to a second closed position and vice versa via a rotating output of the drive motor, said emergency release device comprising:

a decoupling means for decoupling said engagement means from said drive motor in event of an emergency, said decoupling means comprising a safety means for preventing at least one member of the group consisting of unintentional actuation and unauthorized actuation of the decoupling means of said emergency release device during normal operation of the automated door assembly, said safety means comprising one of:

a wire seal requiring manual intervention to neutralize said safety means prior to permitting actuating of said decoupling means, a breakable cover, that covers access to said decoupling means, requiring manual intervention to neutralize said safety means prior to permitting actuating of said decoupling means, and means requiring manual intervention by one of a specialized tool and a specialized key to neutralize said safety means prior to permitting actuating of said decoupling means.

2. The apparatus as set forth in claim 1, wherein said safety means comprises means for preventing said at least one member of the group consisting of unintentional actuation and unauthorized actuation both inside and outside of a building area enclosable by the automated door closure assembly by requiring manual intervention to neutralize said safety means before any actuation of said decoupling means.

3. The apparatus as set forth in claim 1, wherein said decoupling means is adapted for releasing engagement of said engagement means with said drive motor irregardless of a position of a door that is movable by said door closure assembly.

4. The apparatus as set forth in claim 1, wherein said decoupling means mechanically releases an engagement of the engagement means with the drive motor.

5. The apparatus as set forth in claim 4, wherein said decoupling means comprises a mount arranged to facilitate access by a user, and further comprises a manual actuator movable relative to said mount for actuating said emergency release device.

6. The apparatus as set forth in claim 5, further comprising a linking transmission means for releasably coupling said door to said drive motor and transmitting a movement of said decoupling means to said linking transmission means for mechanically releasing a coupling of said door to said drive motor, and wherein said decoupling means comprises a pull handle as said manual actuator which is connected to a traction member of said linking transmission means.

7. The apparatus as set forth in claim 5, wherein said decoupling means is biased in a normal operating position in which said door is coupled to said drive motor via said engagement means and said decoupling means is actuatable to decouple said engagement means from said drive motor, and said emergency device further comprising:

a retaining means for retaining said decoupling means when actuated against said bias of said engagement means, to keep the drive motor uncoupled from the door to permit manual movement of the door, wherein said mount comprises a fastening member for fixing in situ and said retaining means secured to said fastening member in an optionally settable arrangement.

8. The apparatus as set forth in claim 7, said decoupling means comprising a mechanical decoupling means for manual movement to actuate said emergency release device, wherein the decoupling means is mechanically biased in a normal operating position in which said door is coupled to said drive motor operator and actuatable to decouple said engagement means from said drive motor, and a retaining means by means of which said decoupling means is fixable in an actuating position against said bias, wherein said linking transmission means comprises a bowden cable including a traction member guided in a sheath, wherein said retaining means comprises a U-shaped supporting element with two legs and a web inbetween, a first leg of said two legs having a receiving means for said bowden cable and a second leg of said two legs having a receiving means in which said manual actuator translated into said actuating position is fixable in place, wherein said web of said supporting element and said fastening member can each be engaged with the other shiftable relative to each other and fixed in place relative to each other by means of a fastener.

9. The apparatus as set forth in claim 8, wherein said safety means comprises a blocking member which blocks at least one member of the group consisting of movement of and access to said manual actuator, wherein said blocking member comprises a cap screw, and wherein said fastener comprises an adapter comprising a sleeve having two tapped holes, one of which receives a screw locating said supporting element relative to said fastening member and the other receives said cap screw acting as the safety member of said safety means for securing said manual actuator to said adapter.

10. The apparatus as set forth in claim 7, further comprising a linking transmission means for releasably coupling said door to said drive motor and transmitting a movement of said decoupling means to said linking transmission means for mechanically releasing a coupling of said door to said drive motor, and wherein said linking transmission means comprises a bowden cable including a traction member guided in a sheath, wherein said retaining means comprises a U-shaped supporting element with two legs and a web inbetween, a first leg of said two legs having a receiving means for said bowden cable and a second leg of said two legs having a receiving means in which said manual actuator translated into said actuating position is fixable in place, wherein said fastening member of said mount is a bracket having three walls oriented at right angles to each other, on two of said three transitions between said walls a passage opening being formed for optional insertion of said supporting element and on two of said walls two openings are configured optionally serving for wall mounting or for locating a safety member of said safety means, and on the third wall at least one opening is provided for defining said linking transmission means.

11. The apparatus as set forth in claim 5, wherein said mount is adapted for one of left-hand mounting in which said decoupling means is accessible from a left-hand side and right-hand mounting in which said decoupling means is accessible from a right-hand side on a doorjamb to which said door is attachable.

12. The apparatus as set forth in claim 5, wherein said safety means comprises a blocking member which blocks at least one member of the group consisting of movement of and access to said manual actuator.

13. The apparatus as set forth in claim 12, wherein said blocking member comprises a screw fastener.

14. The apparatus as set forth in claim 12, wherein said blocking member is a cap screw defining said manual actuator on said mount of said decoupling means.

15. The apparatus as set forth in claim 14, wherein one of said manual actuator and said mount is provided with one member of the group consisting of a tapped hole and a clamping portion for receiving said cap screw acting as said blocking member.

16. The apparatus as set forth in claim 12, wherein said blocking member is a screw fastener.

17. The apparatus as set forth in claim 12, wherein said blocking member comprises a cap screw.

18. The apparatus as set forth in claim 12, wherein said blocking member comprises a hexagon cap screw.

19. The apparatus as set forth in claim 1, further comprising a linking transmission means for releasably coupling said drive motor to said door and transmitting a movement of said decoupling means to said linking transmission means for mechanically releasing a coupling with said drive motor.

20. The apparatus as set forth in claim 19, wherein said safety means functions to perform both inside and outside of an area enclosable by operation of the automated door assembly by performing at least one step selected from the group consisting of:

blocking movement of said decoupling means;

blocking access to said decoupling means; and blocking said linking transmission means from releasing a coupling of said door to said drive motor.

21. The apparatus as set forth in claim 19, wherein the decoupling means is biased in a normal operating position in which said door is coupled to said drive motor and actuatable to decouple said engagement means from the drive motor.

22. The apparatus as set forth in claim 21, wherein said linking transmission means comprises a spring assembly for biasing said emergency release device in said normal operating position.

23. The apparatus as set forth in claim 22, wherein said linking transmission means comprises a bowden cable including a traction member guided in a sheath, wherein said spring assembly is provided at one end of said bowden cable and biases said traction member relative to said sheath.

24. The apparatus as set forth in claim 21, comprising a retaining means for retaining said decoupling means when actuated against said bias of the linking transmission means, to keep the drive motor uncoupled from the door to permit manual movement of the door.

25. The apparatus as set forth in claim 24, wherein said decoupling means comprises a mount arranged to facilitate access by a user, and a manual actuator movable relative to said mount for actuating said emergency release device, and wherein said linking transmission means comprises a bowden cable including a traction member guided in a sheath, wherein said retaining means comprises a U-shaped supporting element with two legs and a web inbetween, a first leg of said two legs having a receiving means for said bowden cable and a second leg of said two legs having a receiving means in which said manual actuator translated into said actuating position is fixable in place.

26. The apparatus as set forth in claim 25, wherein said decoupling means comprises a mount which facilitates placement of said decoupling means by a user, and comprises a manual actuator movable relative to said mount for actuating said emergency release device, wherein said supporting element of said mount is configured symmetrically about a centerline running transversely to its longitudinal centerline.

27. The apparatus as set forth in claim 19, wherein said coupling means is arranged in a transmission case of a jack-shaft operator and couples a self-locking gearing of said jack-shaft operator to a driven shaft of said jack-shaft operator.

28. The apparatus as set forth in claim 19, wherein said linking transmission means comprises a bowden cable including a traction member guided in a sheath.

29. The apparatus as set forth in claim 28, wherein said traction member comprises a cable wire.

30. The apparatus as set forth in claim 1, wherein said safety means comprises one of said breakable cover and said means requiring manual intervention by one of the specialized tool and the specialized key to neutralize said safety means prior to permitting actuating of said decoupling means.

* * * * *